US005692247A

United States Patent [19]

Ward

[11] Patent Number: 5,692,247

[45] Date of Patent: Dec. 2, 1997

[54] EXHAUST FAN

[76] Inventor: Peter John Ward, 1 Pollard Street, Babinda, Nth Queensland, Australia

[21] Appl. No.: 736,488

[22] Filed: Oct. 24, 1996

Related U.S. Application Data

[63] Continuation of Ser. No. 448,520, filed as PCT/AU93/00618, Dec. 3, 1993, abandoned.

[30] Foreign Application Priority Data

Dec. 15, 1992 [AU] Australia ..... PL6329

[51] Int. Cl.[6] ..... E03D 9/04

[52] U.S. Cl. ..... 4/214; 416/63; 454/343

[58] Field of Search ..... 4/214, 215; 416/62, 416/63; 454/343

[56] References Cited

U.S. PATENT DOCUMENTS

| | | | |
|---|---|---|---|
| 1,381,710 | 6/1921 | Krantz et al. | 4/214 |
| 1,441,007 | 1/1923 | Littlefield | 4/214 |
| 1,624,016 | 4/1927 | Schuck | 4/214 |
| 3,605,126 | 9/1971 | Henry | 4/215 |

FOREIGN PATENT DOCUMENTS

| | | | |
|---|---|---|---|
| 232693 | 10/1959 | Australia . | |
| 246609 | 1/1961 | Australia . | |
| 291638 | 10/1967 | Australia . | |
| 32072/71 | 2/1973 | Australia . | |
| 25315/77 | 11/1978 | Australia . | |
| WO 92/15782 | 9/1992 | European Pat. Off. . | |
| 0197052 | 10/1958 | Germany | 4/214 |

*Primary Examiner*—Charles E. Phillips

*Attorney, Agent, or Firm*—Finnegan, Henderson, Farabow, Garrett, and Dunner, L.L.P.

[57] ABSTRACT

The disclosure herein describes an apparatus for recovering kinetic energy in a free flowing water stream and converting it into useful energy; it comprises a body (22) immerged in a stream, the body defining a duct having an intake side (26) and a discharge side (27). The discharge side is equipped with a deflector (30) which flares outwardly for obstructing the flow of water around the duct to thereby create a negative pressure drag on water being impelled as it is being discharged from the duct. The deflectors flare outwardly at an angle varying from 75° to 160° as measured from the longitudinal axis of the duct.

10 Claims, 2 Drawing Sheets

EXHAUST FAN

This application is a continuation of application Ser. No. 08/448,520, filed as PCT/AU93/00618, Dec. 3, 1993, now abandoned.

BACKGROUND OF THE INVENTION

Exhaust fans are commonly used in domestic situations, particularly for use in kitchens, bathrooms and toilets to remove not only fumes and odours, but also steam from baths and showers. They are also used in public buildings such as in the bathrooms and toilets of hotels, motels, and apartments. In the more humid areas, particularly in the tropical areas it known that these fans are positioned in the ceiling to exhaust into the roof space, or in an outside wall to exhaust directly outside of the building.

These exhaust fans are powered by an electric motor and this electric motor must operate at all times in moisture laden air, and particularly in the tropical areas where the atmospheric relative humidity is continually high, the electric motor, fan, mountings and electrical wiring do not have a chance to dry out. This is detrimental, not only to the electric motor, but also to the metal fittings and to the fan blades and cowling which are often made of metal resulting in corrosion and rusting of the fan and other metal parts and fittings.

Units are known where provision is made for the extraction of air from toilets, and reference is made to AU-24999/84 which is directed to a ventilator for a lavatory pan, there being an electric fan having its inlet connected a duct extending from the cistern to the flush pipe of the pan. A manual switch is operated to switch on the fan, there being a valve in the flush pipe which when the water flows opens, and when the flow of flush water ceases the valve returns to its closed position and in so doing operates the switch to turn off the fan.

AU14859/88 discloses a similar system with the switch being manually operated to turn on the fan, but the switch having a time delay to automatically turn off after a preset period of time.

However these exhaust fans are also driven by electric motors, and so also suffer from the above deficiencies. In addition the fan motors consume electricity which predominantly produced from fossil fuel.

Thus it is an object of the invention to provide an exhaust fan which will overcome one or more of the above disadvantages.

It is a further object of the invention to provide an exhaust fan which is not driven by an electric motor.

A still further object of the invention is to provide an exhaust fan which is not so susceptible to the problems of rust and corrosion.

BRIEF STATEMENT OF THE INVENTION

Thus there is provided according to the invention an exhaust fan, a water driven turbine connected to drive the fan, said water driven turbine having a water inlet and an exhaust, a water supply connected to the said water inlet, said exhaust connected to a point of use of the water that passes through the turbine, characterised in that the turbine comprises a rotor operating within a casing, said rotor comprising a plurality of spiral passages extending from the centre of the rotor to the circumference thereof, said water inlet connected to the centre of the rotor so that the water passes through the spiral passages of the rotor to the exhaust, a control tap positioned between the exhaust of the turbine and the point of use of the water whereby whenever water is used at the point of use, the exhaust fan is driven by the turbine with the turbine being under pressure of the water at all times.

Furthermore there is provided according to the invention a combined exhaust fan water turbine unit with the exhaust fan being direct coupled to the water turbine, said unit being adapted to be installed in a building having a water supply and a point of use of the water, said water supply being connected to the inlet of the turbine and the point of use connected to the exhaust of the turbine, characterised in that the turbine comprises a rotor operating within a casing, said rotor comprising a plurality of spiral arms extending from the centre of the rotor to the circumference thereof, said water inlet passing to the centre of the rotor so that the water passes through the rotor to said exhaust, a control tap positioned between the exhaust of the turbine and the point of use of the water whereby whenever water is used at the point of use, the turbine is driven with the turbine being under the pressure of the water supply at all times.

In a preferred form of the invention the water is taken to the position of the fan in the building.

In a still further preferred form of the invention the water turbine is connected to the fan by a drive which ensures that the fan operates at a speed suitable for exhausting the air from the area concerned.

BRIEF DESCRIPTION OF THE DRAWINGS

In order to more fully describe the invention reference will now be made to the accompanying drawings in which.

DESCRIPTION OF THE PREFERRED EMBODIMENTS

Figure 1:
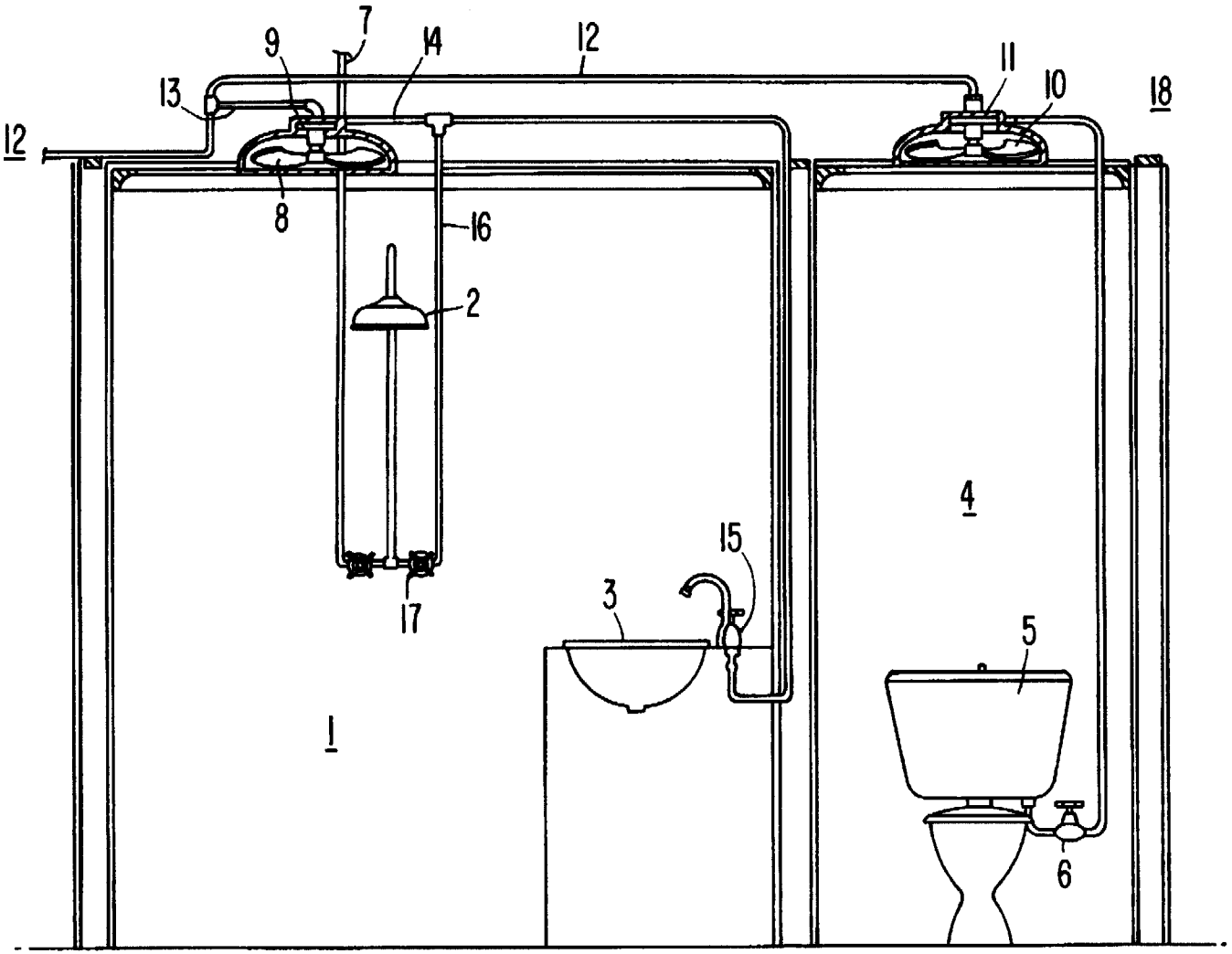
FIG. 1 is a diagrammatic view of the invention applied to a bathroom and a toilet.

In FIG. 1 there is shown one example of the installation and use of the invention. There is shown a bath room 1 having a shower 2 and a hand basin 3, and also a toilet 4 having a system 5 to supply water to a toilet pan 6. A hot water supply 7 is provided to the shower 2, and it will be realised that there would also be a hot water supply (not shown) to the hand basin 3.

The bath room 1 is fitted with an exhaust fan 8 driven by a water turbine 9 while the toilet 4 is fitted with an exhaust fan 10 driven by a water turbine 11. The cold water supply pipe 12 passes along the ceiling and is connected by branch pipe 13 to the inlet to the water turbine 9, the pipe 12 extending to the inlet to the water turbine 11. The exhaust from water turbine 9 is connected by pipe 14 to the cold water tap 15 of the hand basin 3, and is also connected by branch pipe 16 to tap 17 of the shower 2. The exhaust from the turbine 11 is connected by pipe 18 to the inlet to the cistern 5.

Thus it is seen that the water supply to the shower 2 and hand basin 3 is connected through the turbine 9 which drives the exhaust fan 8 so that if either tap 15 or tap 17 is turned on the exhaust fan 8 will immediately be driven by the water flowing through the water turbine 9, thus exhausting the steam and the like from the bathroom.

Similarly it will be seen that when the cistern is flushed during the refill of the water flow through the turbine 11 will drive the exhaust fan 11 to change the air in the toilet.

Figure 2:
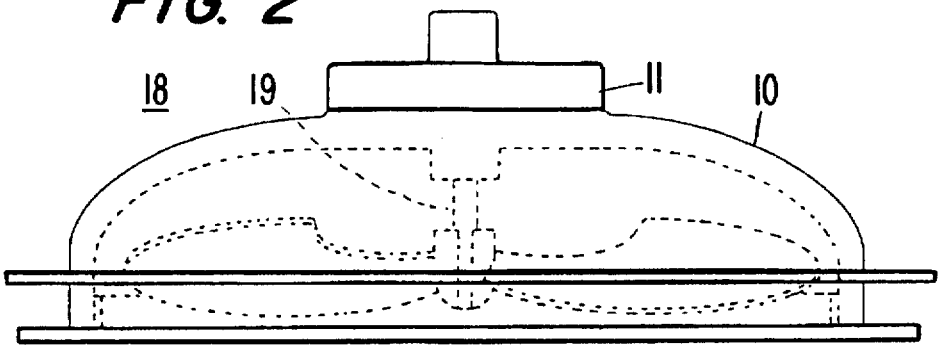
FIG. 2 is a view of the fan and drive unit.

FIG. 2 is a view of a combined exhaust fan 10 and water driven turbine 11 with the fan impeller 18 being direct coupled to the driving shaft 19 of the water turbine 11.

Figure 3:
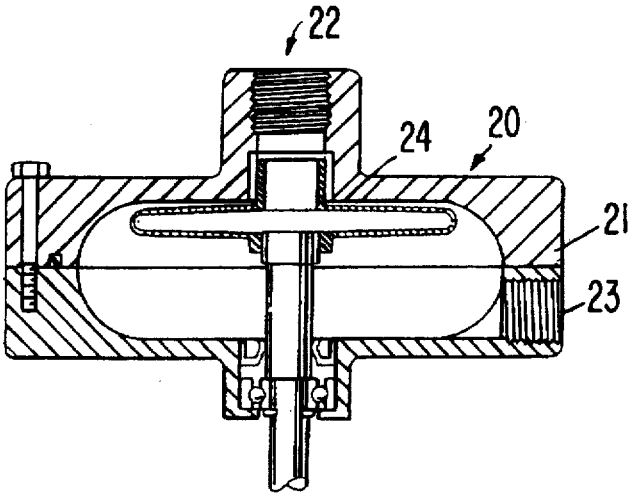
FIG. 3 is a sectional view of one form of water turbine.
Figure 4:
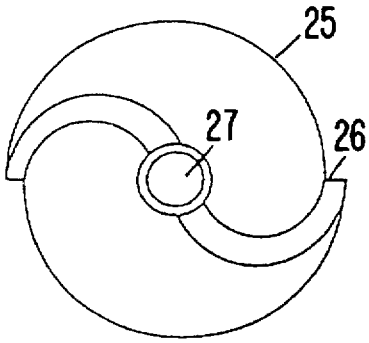
FIG. 4 is a view of the rotor of a turbine.

FIG. 3 shows in cross section one form of water turbine 20, the casing 21 having a water inlet 22 and a water outlet 23, the inlet 22 passing water axially to the rotor 24. The rotor 24 is attached on one side to a drive shaft extending through the casing 21, which shaft is attached outside the casing to a fan impeller 18. The other side of the rotor 24 includes an axial water inlet opening which is positioned in water inlet 22. The rotor 24 can have a plurality of spiral passages extending from the centre of the rotor to the circumference thereof. One form of such rotor is shown in FIG. 4 where the impeller 25 has the passages 26 extending from the central inlet 27.

Figure 5:
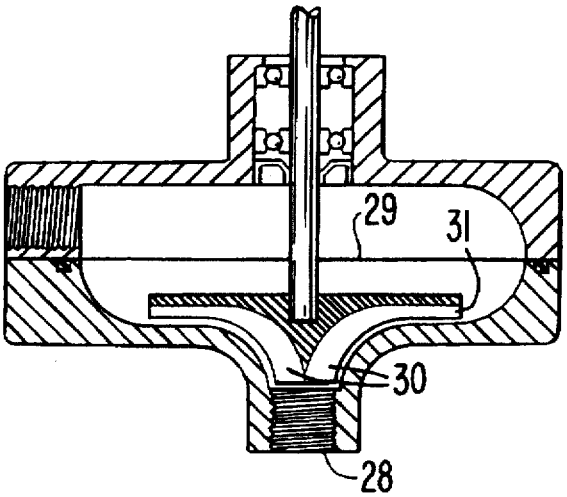
FIG. 5 is a view of a further water turbine.
Figure 6:
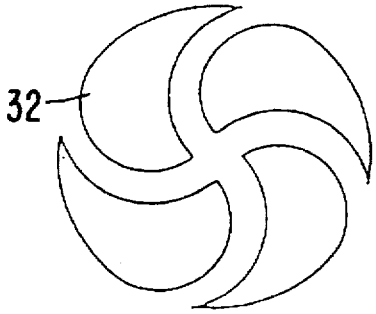
FIG. 6 is a view of a further rotor of a turbine.

FIG. 5 shows a further form of turbine where again the water inlet 28 is axial to the rotor 29, the curved or spiral passages 30 extending from the axial inlet to a radial and tangential discharge 31. A still further form of rotor 32 is shown in FIG. 6, again the water entering axially and discharging tangentially of the rotor.

Thus as described the tap (6,15,17) is positioned between the point of use and the turbine, and thus it will be seen that the turbine (9,11) is always under the pressure of the water supply. It also follows that the turbine thus operates in under the pressure of the water which pressure is maintained to the point of use.

Hence it will be seen the exhaust fan can be driven by one of a number of water turbines. It will be appreciated that the exhaust fan can be positioned as desired in the room, either in the wall or in the ceiling, so that steam, water vapour and other gasses and odours are exhausted from the room.

While it is desired that the fan be direct coupled to the shaft of the turbine, it is to be realised that in some instances there may be either a step-up drive or a step-down drive connection between the water turbine and the fan, depending on the turbine and the fan size. Thus the driving connection between the water turbine and the fan can be a belt drive or an enclosed gear train drive.

Thus when the fan is installed in a bathroom having a shower, bath, toilet, bidet and hand basin, the cold water supply to each of these is from a single point of entry and passes through the water turbine before being branched to the various points of use. In this way irrespective of which of the unit uses cold water, the water turbine will operate to drive the exhaust fan.

The components of the water turbine and the fan can all be produced of a suitable plastics material, so that rust and corrosion can be eliminated. Thus the housing of the turbine and also the rotor itself can be produced of a plastics material, as can the fan blades and the surrounding casing and protective grill.

Although various forms of the invention have been described in detail, it is to be realised that the invention is not to be limited thereto but can include variations and modifications falling within the spirit and scope of the invention.

I claim:

1. A combined exhaust fan-water turbine exhaust unit adapted to be installed in a building, which comprises:

(a) a water turbine comprising a casing having a water inlet in a wall thereof and adapted for connection by a pipe to a water supply, and a water outlet in a wall of the casing and adapted for connection by a pipe to at least one point of use of the water, and a rotor positioned within said casing and supported on a first side by a first end of a shaft, said shaft extending thru a wall of said casing, said rotor having a plurality of spiral passages extending radially from an axial water inlet passage on a second side of the rotor opposite said first side toward a circumference of the rotor, said axial water inlet passage of the rotor being positioned in said water inlet in the wall of the casing such that water introduced through the water inlet passes through the spiral passages of the rotor to said water outlet; and (b) an exhaust fan connected to a second end of said shaft of said rotor of said turbine, so that water passed through said turbine causes the turbine to rotate the fan.

2. The exhaust unit as defined by claim 1, wherein said water inlet is coaxial with the center of said turbine rotor, and said water outlet is positioned radially from said center.

3. The exhaust unit as defined by claim 1, wherein said rotor has a plurality of said spiral passages.

4. An exhaust system comprising an exhaust fan adapted to installed in a building to extract vapors from the building, a water driven turbine connected to drive the fan, said water driven turbine having a casing provided with a water inlet and a water outlet, a water supply connected by a first pipe to said water inlet, said water outlet being connected by a second pipe to a point of use of the water, wherein the turbine includes a rotor within said casing, said rotor being supported on a first side by a shaft, said shaft extending through the casing and having said fan connected to a second end thereof, said rotor having a second side provided with an axial water inlet passage positioned in said water inlet of said casing, said axial water inlet opening into a plurality of spiral passages extending radially from the center of the rotor toward a circumference thereof, said axial water inlet being positioned such that the water passes there through to the spiral passages of the rotor and to the water outlet, a control tap positioned between the water supply and the point of use of the water so that whenever water is used at the point of use, the exhaust fan is driven by the rotor of the turbine, said turbine being under pressure of the water whenever water is being used at the point of use.

5. The exhaust system as defined in claim 4, wherein the exhaust fan is adapted to be installed in a bathroom or toilet, each having a point of use of water and said water supply is connected to the inlet to the water turbine, the water outlet being connected to a point of use which is one or more of a bath, shower, hand basin or toilet cistern, so that whenever water is used at said point of use the water turbine drives the exhaust fan.

6. The exhaust system as defined in claim 4, wherein the exhaust fan and the water turbine are connected to form an integral unit.

7. The exhaust system as defined in claim 4, wherein the water turbine is a reaction turbine, or a positive pressure turbine.

8. The exhaust system as defined in claim 4, wherein said water outlet is connected to a plurality of points of use.

9. The exhaust system as defined in claim 4, wherein the control tap is positioned in said second pipe between said water outlet and said point of use so that the turbine is under the pressure of the water supply at all times.

10. The exhaust system as defined by claim 4, wherein a first and a second water supply are connected to said water inlet.

* * * * *

UNITED STATES PATENT AND TRADEMARK OFFICE

CERTIFICATE OF CORRECTION

PATENT NO. : 5,692,247
DATED : December 2, 1997
INVENTOR(S) : J. Peter Ward

It is certified that error appears in the above-indentified patent and that said Letters Patent is hereby corrected as shown below:

Title page, Abstract, delete the Abstract and insert

--An exhaust fan is driven by a water turbine. The water turbine is connected between the water supply and point of use so that when the water is used, e.g., shower, bath, toilet, the fan is driven by the water turbine--.

Claim 4, line 29, after "by a", insert --first end of a--.

Signed and Sealed this
Seventeenth Day of March, 1998

Bruce Lehman

*Attest:*

BRUCE LEHMAN

*Attesting Officer*

*Commissioner of Patents and Trademarks*